United States Patent [19]

Shintani et al.

[11] 4,027,190

[45] May 31, 1977

[54] METAL HALIDE LAMP

[75] Inventors: Takao Shintani, Tokyo; Satoshi Nagano, Kawasaki; Toshihiko Ishigami, Tokyo; Hiroki Sasaki, Yokohama, all of Japan

[73] Assignee: Tokyo Shibaura Electric Co., Ltd., Kawasaki, Japan

[22] Filed: Sept. 2, 1976

[21] Appl. No.: 719,703

[30] Foreign Application Priority Data

| | | |
|---|---|---|
| Sept. 5, 1975 | Japan | 50-107110 |
| Mar. 29, 1976 | Japan | 51-33577 |
| June 17, 1976 | Japan | 51-70399 |

[52] U.S. Cl. ..... 313/229; 313/225

[51] Int. Cl.[2] ..... H01J 61/18

[58] Field of Search ..... 313/229

[56] References Cited

UNITED STATES PATENTS

| | | | |
|---|---|---|---|
| 3,882,345 | 5/1975 | Kazek et al. | 313/229 |
| 4,001,626 | 1/1977 | Drop et al. | 313/229 |

*Primary Examiner*—Rudolph V. Rolinec
*Assistant Examiner*—Darwin R. Hostetter
*Attorney, Agent, or Firm*—Cushman, Darby & Cushman

[57] ABSTRACT

In a metal halide lamp including a luminous sealed tube which is equipped with a pair of discharge electrodes and has an inonizable inert gas and mercury sealed therein, the luminous sealed tube further includes, in addition to tin halide (exclusive of tin fluoride), calcium halide (exclusive of calcium fluoride) or strontium halide (exclusive of strontium fluoride) or their mixture. The metal halide lamp shows a high color rendering property.

4 Claims, 8 Drawing Figures

METAL HALIDE LAMP

This invention relates to an improved metal halide lamp or an improved high pressure discharge lamp.

A conventional metal halide lamp principally directed to obtaining a high color rendering property is disclosed in U.S. Pat. No. 3,566,178, the applicant of which is identical with the applicant of this application i.e. Tokyo Shibaura Electric Co., Ltd. Kawasaki-shi, Japan. The conventional metal halide lamp includes a luminous sealed tube equipped with a pair of discharge electrodes and having, in addition to ionizable inert gas and mercury, tin halide sealed therein. The general color rendering index Ra of the metal halide lamp is about 86 to 92 and the special color rendering index for red color $R_9$ is about 75. However, these index values are not always satisfactory.

It is accordingly the object of this invention to provide a metal halide lamp having an improved color rendering property.

A metal halide lamp of this invention includes a luminous sealed tube equipped with a pair of discharge electrodes and having an ionizable inert gas, mercury and halides sealed therein. The above-mentioned halides is a mixture of tin halide exclusive of tin fluoride, and calcium halide exclusive of calcium fluoride; or a mixture of tin halide exclusive of tin fluoride, and strontium halide exclusive of strontium fluoride; or a mixture of tin halide exlusive of tin fluoride, calcium halide exclusive of calcium fluoride and strontium halide exclusive of strontium fluoride.

When the above-mentioned halides are constituted of tin halide exclusive of tin fluoride and calcium halide exclusive of calcium fluoride, 0.1 to 5.0 mg of said tin halide and 0.005 to 3.0 mg of said calcium halide, respectively, per ml of the inner volume of a luminous sealed tube are desirably used.

When the above-mentioned halides are constituted of tin halide exclusive of tin fluoride and strontium halide exclusive of strontium fluoride, 0.1 to 5.0 mg of said tin halide and 0.01 to 3.0 mg of said strontium halide, respectively, per ml of the inner volume of the luminous sealed tube are preferably used.

When the above-mentioned halides are constituted of tin halide exclusive of tin fluoride, calcium halide exclusive of calcium fluoride and strontium halide exclusive of strontium fluoride, 0.1 to 5.0 mg of said tin fluoride, 0.01 to 3.0 mg of calcium halide and 0.01 to 3.0 mg of strontium halide are preferably used.

Figure 1:
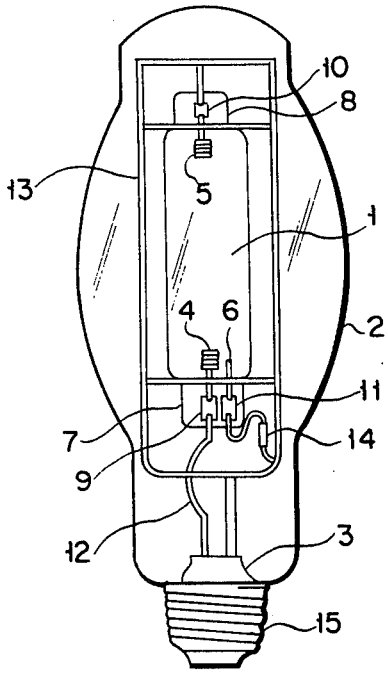

This invention can be more fully understood from the following detailed description when taken in conjunction with the accompanying drawings, in which:

FIG. 1 is a front view showing, by way of example, the structure of a metal halide lamp according to this invention; and FIGS. 2 to 8 are characteristic curves each showing a wavelength-relative spectral enregy ratio as obtained from the metal halide lamp according to this invention.

A metal halide lamp according to this invention will be described by referring to FIG. 1 of the accompanying drawings.

A luminous sealed tube 1 constituting a light transmitting value is supportingly fixed to a stem 3 within an evacuated envelope 2. Halides of this invention, in addition to 10–40 torr of innert gas and 1–6 mg/ml of mercury are sealed within the luminous sealed tube 1. A pair of main electrodes 4, 5 and a starting auxiliary electrode 6 are sealed in the sealed tube. One main electrode 4 is connected, through a molybdenum foil 9 sealed to a pinch seal 7 of the luminous sealed tube 1, to a supporting pole 12 which is made of metal wire secured to the stem 3. The other electrode 5 is connected, through a molybdenum foil 10 sealed to a pinch seal 8, to a supporting frame 13 which is made of metal wire and secured to the stem 3. The auxiliary electrode 6 is connected to the supporting frame 13 through a molybedenum foil 11 sealed to pinch seal 7 and resistor 14. The supporting pole 12 and supporting frame 13 are fitted to the outer circumference and central portion of a base 15 respectively.

When a voltage is applied between the main electrodes 4, 5 and the auxiliary electrode 6, a slight discharge occures first between the main electrode 4 and the auxiliary electrode 6. Then, an arc discharge occurs between the main electrodes 4 and 5.

The luminous sealed tube 1 is heated by a heat resulting from the arc discharge, causing the vapor pressure of mercury, and halides to be raised and gradually intensifying light emission for stability. Part of tin halide is dissociated at an arc column to cause light emission of tin atoms. The most of tin halide, however, maintains its molecular state. The tin halide etc., constituting a vaporable material in the luminous sealed tube 1, emits a strong spectrum at the operating temperature of the luminous sealed tube, and red component-dominant calcium halide and strontium halide are superposed on the above-mentioned spectrum to cause strong light emission.

This invention will be well understood from the following examples and controls.

EXAMPLE 1

A metal halide lamp the same type as in FIG. 1 was prepared by inserting 20 torrs of argon gas (inert gas), 2 mg of mercury, 0.7 mg of tin dibromide and 1.3 mg of calcium iodide per ml of the inner volume of the luminous sealed tube having an inner volume of about 15 ml. The following are results of experiments when the lamp was operated at an input power of 400W and the light emission characteristics as mentioned below were confirmed.

1. Distribution of light emission energy

Figure 2:
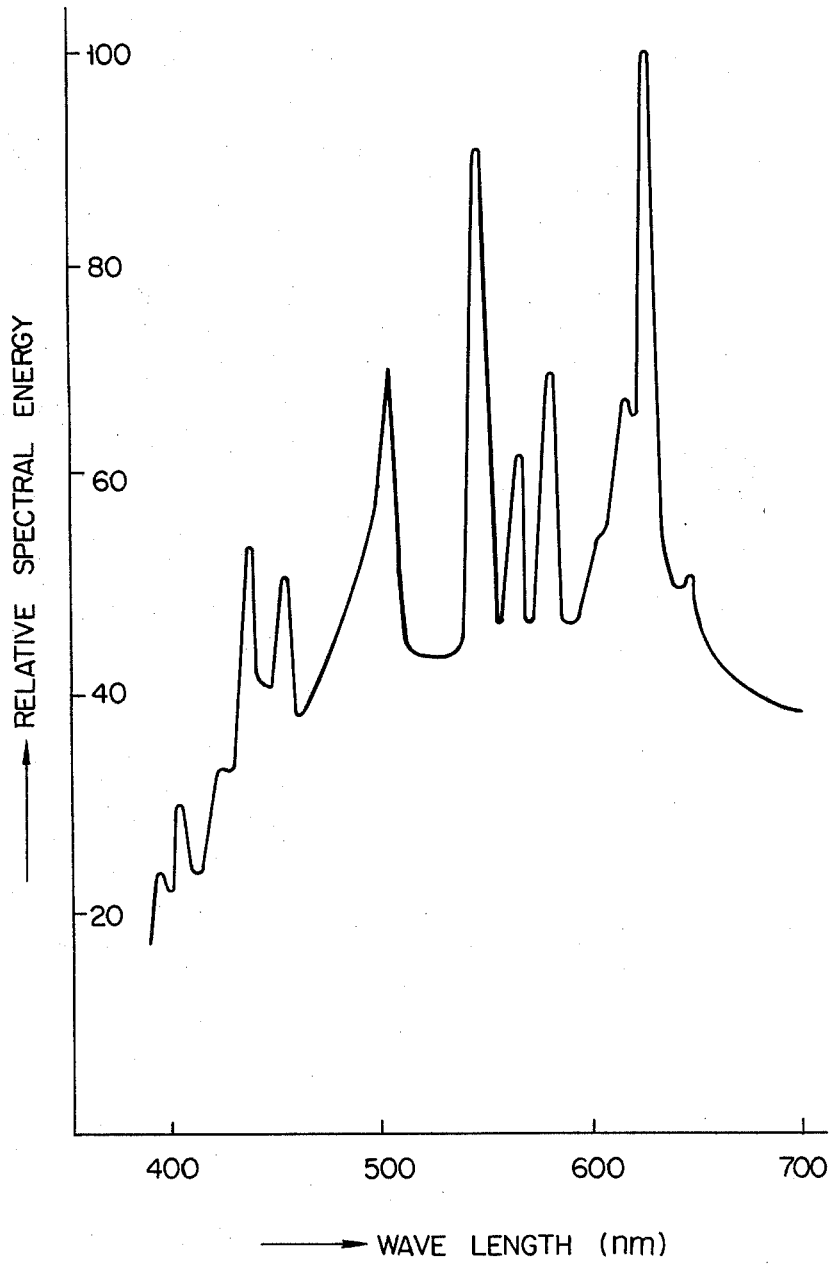

A wavelength-relative spectral energy characteristic is shown in FIG. 2. In the discharge lamp, a CaBr molecular spectrum shows an intense light emission at a wavelength of 625 (nm) to 627 (nm); a Hg atomic spectrum at a wavelength of 546 (nm); a HgBr molecular spectrum at a wavelength of 502 (nm); and the Hg atomic spectrum at a wavelength of 579 (nm) and a Ca atomic spectrum at a wavelength of 616 (nm). These spectra are superposed on a continuous spectrum of tin bromide and tin iodide which extends with a wavelength of 550 to 600 (nm) at a maximum. The spectral energy intensity of each material is shown in Table 1.

Table 1

| Material | Wavelength (nm) | Spectral energy intensity |
|---|---|---|
| CaI | 641 to 646 | 51.1 |
| CaBr | 625 to 627 | 100.0 |
| Ca · CaBr | 612,614 to 616 | 68.0 |
| Hg | 579 | 69.7 |
| Sn | 563 | 63.2 |
| Hg | 546 | 92.1 |
| HgBr | 502 | 71.7 |
| Sn | 453 | 51.6 |

Table 1-continued

| Material | Wavelength (nm) | Spectral energy intensity |
|---|---|---|
| Hg | 435 | 54.7 |
| Ca | 422 | 33.8 |
| Hg | 405 | 30.5 |

*Note that the spectral energy intensity of calcium bromide with a wavelength of 625 (nm) to 627 (nm) was plotted as a relative value of 100.

2. Chromaticity

It was found that in a CIE chromaticity diagram (the field of vision of 2°) the chromaticity was superposed almost on the locus of a black body at a color temperature of about 4500° to 4400° K and an ideal white color was obtained.

3. Color rendering

Color rendering indices calculated from the spectral energy distribution curve shown in FIG. 2 by a test color method as specified by the Commission Internationale de l'Enclairage (C.I.E.) showed that the general color rendering index Ra = 98.9 and a special color rendering index for red color, $R_9 = 96$.

4. Efficiency

The efficiency of the tube was found to be approximately 70 lm/W.

5. Performance

Any of the tin bromide and calcium iodide sealed in the tube was a chemically stable material. The use of calcium iodide alleviated an electrode corrosion by tin bromide, and improved the performance and life services of the lamp.

6. Flickering of light output

In this Example, flickering of light output was found to be very small. It is because that the fluctuation of a continuous spectrum in which light rays are emitted is 20 to 30% and such light rays comprises the major portion of the light output.

Control 1

A discharge lamp the same type as in Example 1 was prepared by sealing 20 torrs of argon gas (inert gas), 2 mg of mercury and 0.7 ml of tin dibromide per ml of the inner volume of the lamp (no clacium diiodide was sealed). The following are results of experiments when this lamp was operated at an electric power of 400 watts.

For a color temperature of about 6500° K a general color rendering index Ra = 89 and a special color rendering index for red color, $R_9 = 68$. The efficiency of the lamp was found to be 70 lm/W. However it was impossible to obtain a sufficient color rendering property as compared with Example 1.

EXAMPLE 2

A discharge lamp the same type as in Example 1 was prepared by sealing 20 torrs of argon gas (inert gas), 2 mg of mercury, 0.5 mg of tin dichloride and 2.0 mg of calcium diiodide per ml of the inner volume of the lamp. The following light emission characteristics were observed when the lamp was operated at an input power of 400 watts.

1. Spectral energy distribution

Figure 3:
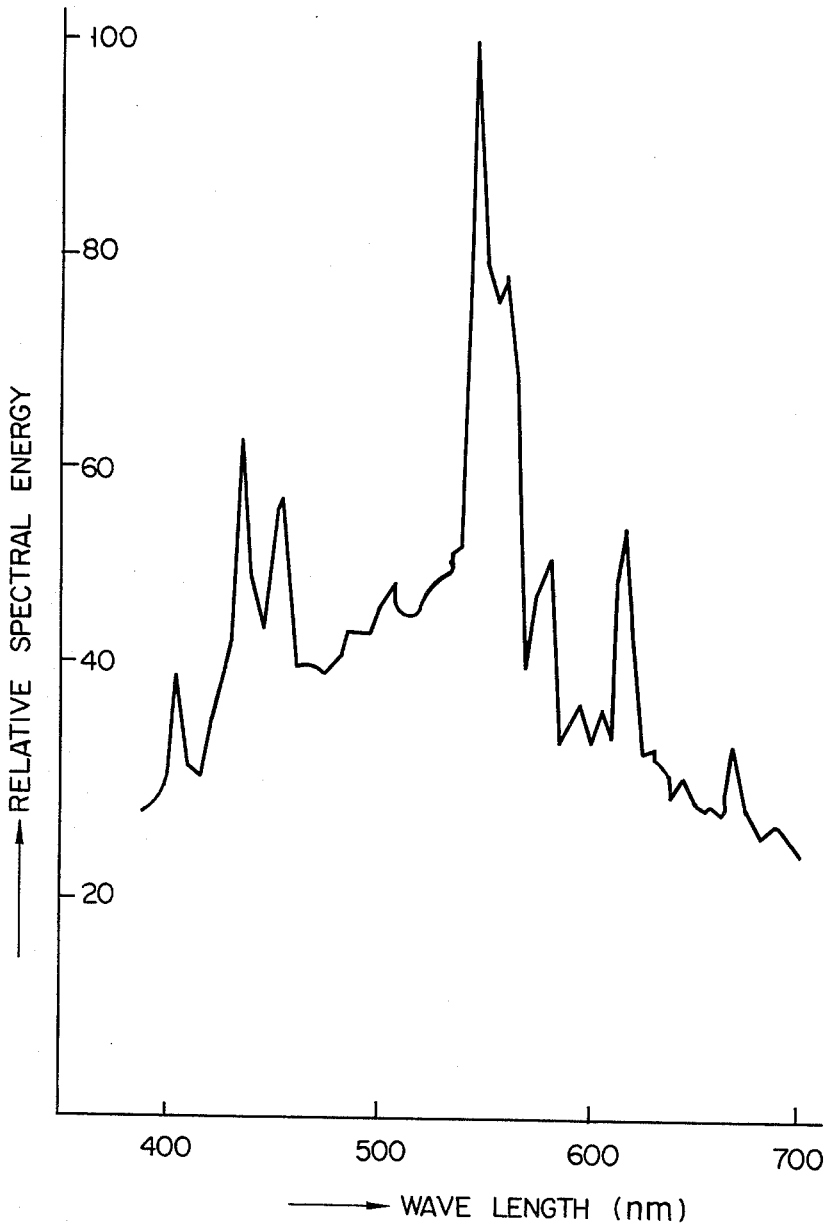

A wavelength-relative spectral energy characteristic curve is shown in FIG. 3. In this discharge lamp, a molecular spectrum is emitted at a wavelength of 546 (nm) for mercury, at a wavelength of 557 (nm) and 563 (nm) for mercury chloride and at a wavelength of 621 (nm) for calcium chloride. These spectra are superposed on a continuous spectrum of tin dichloride which extends with a wavelength of about 500 nm at maximum. The spectral energy intensity of each material is shown as Table 2.

Table 2

| Material | Wavelength (nm) | Spectral energy intensity |
|---|---|---|
| CaCl | 621 | 56.3 |
| Hg | 579 | 53.4 |
| HgCl,Sn | 563 | 77.8 |
| HgCl | 557 | 78.8 |
| Hg | 546 | 100.0 |
| Sn | 453 | 57.1 |
| Hg | 435 | 63.2 |
| Hg | 405 | 41.4 |

It is to be noted that the spectral energy intensity of mercury with a wavelength of 546 nm shows a relative value of 100.

2. Chromaticity

In a CIE chromaticity diagram (the field of vision is 2°), the chromaticity involves a color temperature of about 5900° K, increasing a tinge of red color as compared with tin chloride having a color temperature of 6250° K.

3. Color rendering

In this Example, color rendering indices calculated from the spectral energy distribution curve shown in FIG. 3 by the CIE specification showed that a general color rendering index Ra = 83.1 and a special color rendering index for red, $R_9 = 31$.

4. Efficiency

The efficiency of this lamp was found to be about 70 lm/W.

Control 2

An electric discharge lamp the same type as in Example 2 was prepared by sealing 20 torrs of argon gas (inert gas), 2 mg of mercury and 0.5 mg of tin dichloride per ml of the inner volume of the lamp (no calcium diiodide is sealed) and the following are results of experiments when the lamp was operated at an electric power of 400 watts.

The color temperature was about 6250° K and the general color rendering index Ra = 69 and it was impossible to obtain a sufficient color rendering property as compared with Example 2.

EXAMPLE 3

Metal halide lamps the same type as in FIG. 1 were prepared by sealing into a luminous sealed tube having a spacing between main electrodes of 42 mm and an inner volume of 15 ml, 20 torrs of argon gas (inert gas), 48 mg of mercury, a varying amount of $SnBr_2$ as a tin halide and a varying amount OF $CaI_2$ as a calcium halide. Each sample was tested at an input power of 400W. For the samples with 0.1 to 5.0 mg/ml of $SnBr_2$ and 0.01 to 3.0 mg/ml of $CaI_2$, lamps having excellent light color were obtained at a color temperature range of 3600° to 8000° K with a general color rendering index Ra of more than 90. Table 3 shows the results of experiments conducted.

Table 3

| Sample No. | A sealed amount of $SnBr_2$ (mg/ml) | A sealed amount of $CaI_2$ (mg/ml) | General color rendering index Ra | Special color rendering index for red color $R_9$ | Color temp. (° K) |
|---|---|---|---|---|---|
| 1 | 4.0 | 0.01 | 96 to 92 | 81 to 78 | 6300 to 5900 |
| 2 | 1.0 | 0.23 | 97 to 95 | 95 to 90 | 5800 to 5500 |
| 3 | 0.9 | 0.9 | 99 to 97 | 98 to 95 | 4100 to 3600 |
| 4 | 0.8 | 0.12 | 98 to 97 | 96 to 93 | 5200 to 4600 |
| 5 | 0.7 | 0.35 | 99 to 97 | 99 to 96 | 4900 to 4100 |
| 6 | 0.53 | 1.6 | 97 to 95 | 95 to 92 | 4100 to 3700 |
| 7 | 0.12 | 0.12 | 96 to 90 | 89 to 70 | 10000 to 8000 |
| 8 | 0.06 | 0.9 | 73 to 71 | 60 to 47 | 7800 to 7200 |

Figure 4:
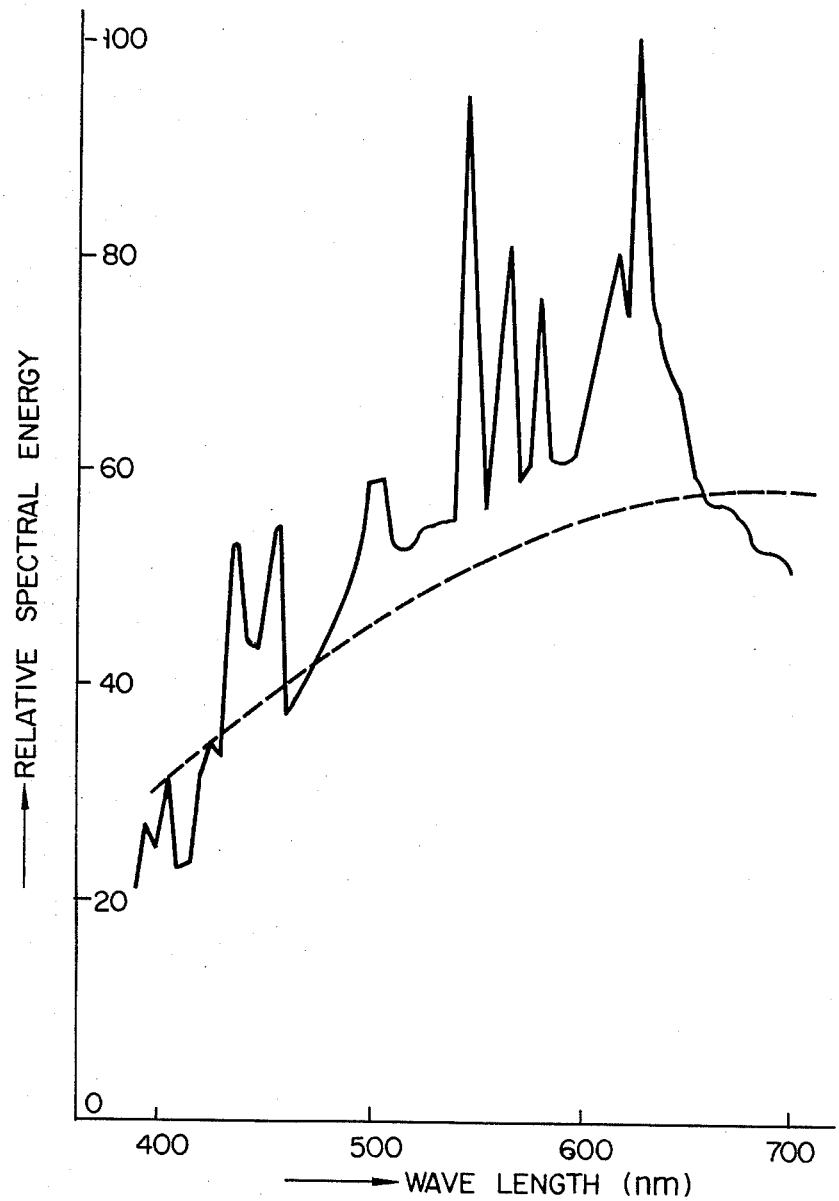
Figure 5:
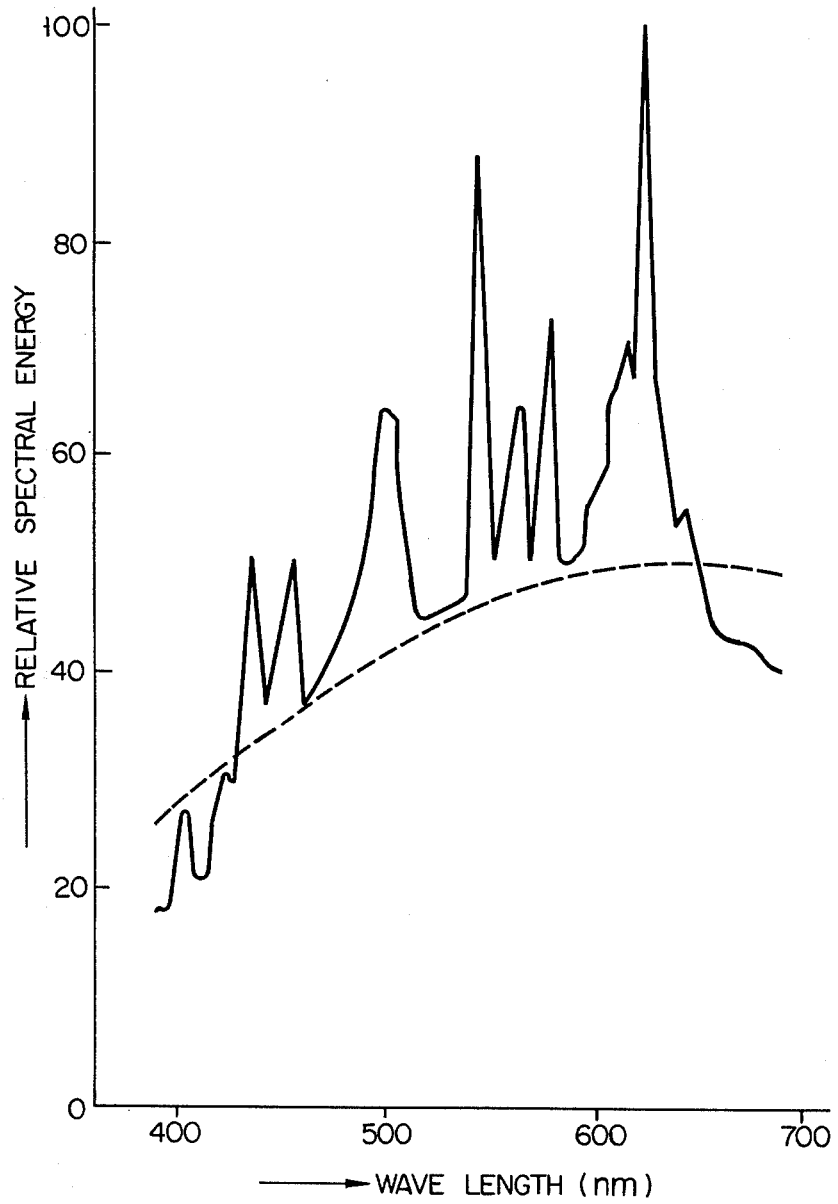
Figure 6:
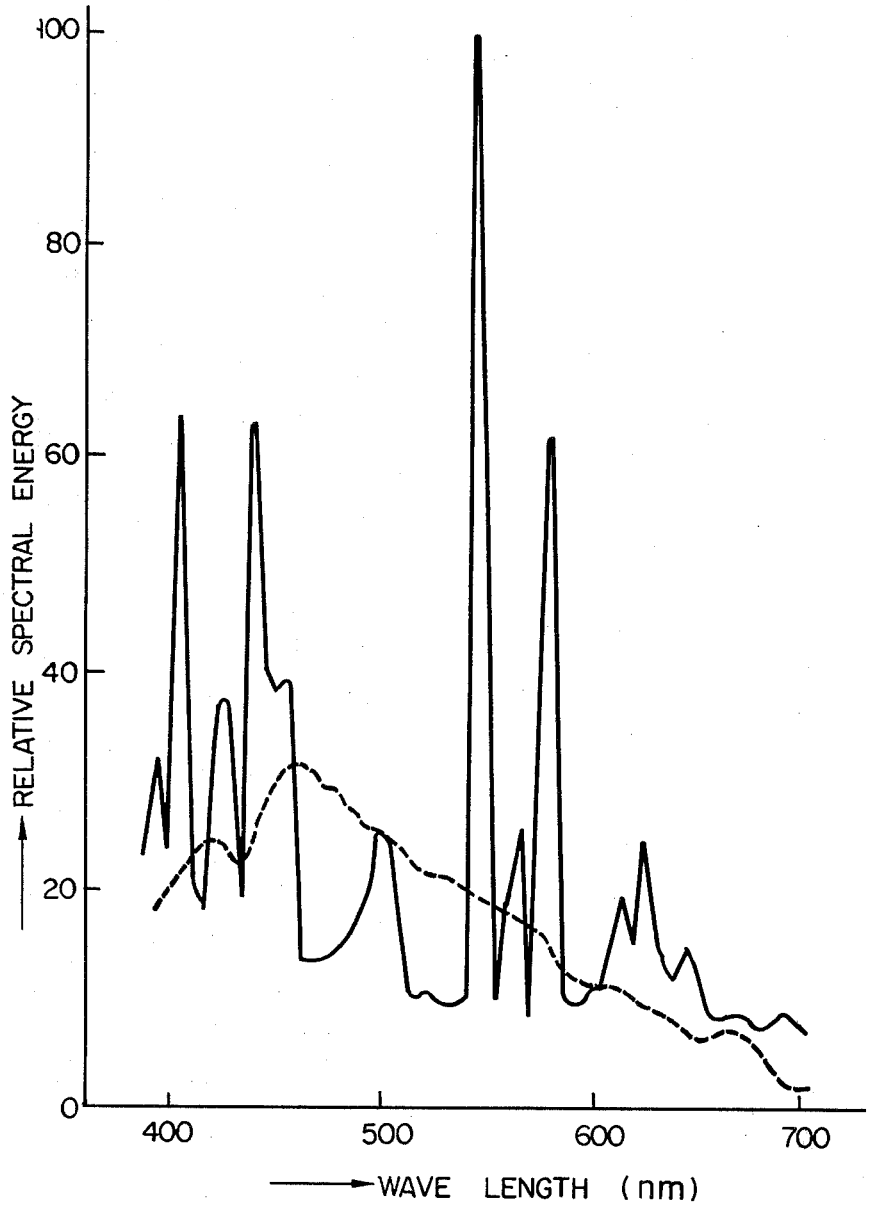

The solid lines of FIGS. 4, 5 and 6 respectively show wavelength-relative spectral energy ratio characteristics of the samples 3, 5 and 8 and the broken lines of FIGS. 4, 5 and 6 show natural light characteristics at temperatures of 4100° K, 4300° K and 7750° K, respectively. In this embodiment, an arc is readily subjected to instability due to the sealed tin bromide, but it can be made stable by inserting calcium iodide.

EXAMPLE 4

Metal halide lamps the same type as in Example 1 were prepared by sealing a varying amount of $SnBr_2$ as tin halide and a varying amount of $CaBr_2$ as calcium halide. Each sample was tested at an input power of 400W. As a result, for samples having 0.1 to 5.0 mg/ml of $SnBr_2$ and 0.005 to 2.0 mg/ml of $CaBr_2$, a general color rendering index Ra is more than 90°. The metal halide lamp having excellent light color was obtained at a color temperature of 3600° to 8000° K. The following are the results of experiment conducted.

Table 4

| Sample No. | A sealed amount of $SnBr_2$ (mg/ml) | A se. 'ed amount of $CaBr_2$ (mg/ml) | General color rendering index Ra | Special color rendering index for red color $R_9$ | Color temp. (° K) |
|---|---|---|---|---|---|
| 9 | 4.0 | 0.01 | 94 to 92 | 81 to 76 | 6500 to 6000 |
| 10 | 2.0 | 2.5 | 99 to 96 | 98 to 95 | 4400 to 3900 |
| 11 | 1.0 | 0.24 | 98 to 96 | 97 to 95 | 5300 to 4900 |
| 12 | 0.7 | 0.003 | 95 to 92 | 77 to 71 | 6000 to 5600 |
| 13 | 0.1 | 0.9 | 88 to 83 | 73 to 60 | 12000 to 9500 |
| 14 | 0.7 | 1.6 | 99 to 96 | 97 to 95 | 4600 to 4000 |
| 15 | 0.05 | 0.4 | 78 to 72 | 67 to 41 | 10700 to 9400 |

EXAMPLE 5

Metal halide lamps the same type as in Example 1 were prepared by sealing a varying amount of $SnBr_2$ as tin halide and a varying amount of $CaCl_2$ as calcium halide. Each sample was tested at an input power of 400W. As a result, for the sample having 0.1 to 5.0 mg/ml of $SnBr_2$ and 0.01 to 2.0 mg/ml of $CaCl_2$, a general color rendering index Ra was more than 90 and discharge lamps having excellent light color were obtained at a color temperature of 3600° to 8000° K. Table 5 shows test results conducted.

Table 5

| Sample No. | A sealed amount of $SnBr_2$ (mg/ml) | A sealed amount of $CaCl_2$ (mg/ml) | General color rendering index Ra | Special color rendering index for red color $R_9$ | Color temp. (° K) |
|---|---|---|---|---|---|
| 16 | 4.0 | 0.01 | 94 to 92 | 75 to 70 | 6400 to 5900 |
| 17 | 1.0 | 0.001 | 94 to 90 | 76 to 73 | 5800 to 5600 |
| 18 | 1.0 | 2.0 | 90 to 87 | 82 to 78 | 5100 to 4500 |
| 19 | 0.07 | 0.3 | 81 to 77 | 60 to 47 | 11000 to 9300 |
| 20 | 0.35 | 0.12 | 96 to 92 | 94 to 90 | 5500 to 4800 |

EXAMPLE 6

Discharge lamps the same type as in Example 1 were prepared by sealing 0.5 to 5.0 mg/ml of $SnI_2$ as tin halide and 0.01 to 2.0 mg/ml of $CaI_2$ as calcium halide. A general color rendering index Ra is more than 90 and the discharge lamps having excellent light color were obtained at a color temperature of 3600° to 8000° K.

EXAMPLE 7

Discharge lamps the same type as in Example 1 were prepared by sealing 0.3 to 5.0 mg/ml of $SnI_2$ as tin halide and 0.01 to 2.0 mg/ml of $CaBr_2$ as calcium halide. The general color rendering index Ra is more than 90 and the discharge lamp having excellent light color were obtained at a color temperature of 3600° to 8000° K.

EXAMPLE 8

Discharge lamps the same type as in Example 1 were prepared by sealing 0.3 to 5.0 mg/ml of $SnI_2$ as tin halide and 0.05 to 1.0 mg/ml of $CaCl_2$ as calcium halide. The general color rendering index Ra was more than 90° and discharge lamps having excellent light color were obtained at a color temperature of 3600° to 8000° K.

EXAMPLE 9

Discharge lamps the same type as in Example 1 were prepared by sealing 0.3 to 3.0 mg/ml of $SnCl_2$ as tin halide and 0.01 to 2.0 mg/ml of $CaI_2$ as calcium halide. The general color rendering index Ra was more than 90 and the discharge lamps having excellent light color were obtained at a color temperature of 3600° to 8000° K.

EXAMPLE 10

Discharge lamps the same type as in Example 1 were prepared by sealing 0.3 to 3.0 mg/ml of $SnCl_2$ as tin halide and 0.01 to 2.0 mg/ml of $CaBr_2$ as calcium halide. The general color rendering index Ra was more than 90 and the discharge lamps having excellent light color were obtained at a color temperature of 3600° to 8000° K.

EXAMPLE 11

Discharge lamps the same type as in Example 1 were prepared by sealing 0.1 to 2.0 mg/ml of $SnCl_2$ as tin halide and 0.01 to 2.0 mg/ml of $CaCl_2$ as calcium halide. The average color rendering index Ra was more than 90 and the discharge lamps having excellent light color were obtained at a color temperature of 3600° to 8000° K.

Where as in the above-mentioned embodiments halides sealed in a luminous sealed tube comprised tin halide (exclusive of tin fluoride) and calcium halide (exclusive of calcium fluoride), when 0.1 to 5.0 mg/ml of tin halide and 0.005 to 3.0 mg/ml of calcium halide, respectively, per ml of the inner volume of the luminous sealed tube was sealed in the tube, a discharge lamp was obtained having a high color rendering property as compared with a conventional discharge lamp. It is undesirable that fluoride is sealed as a halide into a luminous sealed tube. It is because that fluoride involves an intense corrosion.

In Example 3, 0.7 to 0.9 mg/ml of tin bromide and 0.01 to 0.9 mg/ml of calcium iodide were sealed into the luminous sealed tube 1 and no prominent change in the color rendering property and color temperature was observed. It is because that calcium of alkaline earth element has a tendency for an arc temperature to be lowered, the vapor pressure of calcium iodide is about 1 torr at 800° C, and so on. That is, at the normal tube wall temperature (about 550° C) the vapor pressure of calcium iodide is very low and a variation in the amount of calcium iodide sealed does not contribute much to the variation of characteristic of the discharge lamp.

Tin, calcium, bromine, chlorine and iodine can be sealed in the form of tin halide and calcium holide into the luminous tube. Alternatively, they are sealed in the form of a bond of halogen with mercury into the luminous tube together with tin and calcium. Tin, calcium, strontium and halogen can be sealed either in a single form or in the form of a compound (for example, calcium oxide, strontium oxide, tin halide, calcium halide) into the luminous tube and in this case they are incorporated as part or whole of an electrode or emitter structure into the luminous tube.

EXAMPLE 12

Discharge lamps the same type as in Example 1 were prepared by sealing 20 torrs of argon gas (inert gas), 2 to 2.5 mg/ml of mercury and a varying amount of $SnBr_2$ as tin halide and a varying amount of $SrI_2$ as strontium halide into a luminous tube having a spacing between main electrodes of 40 mm and an inner volume of 13 ml. The following are results of experiments when the discharge lamps were operated at an input power of 400W.

Table 6

| Sample No. | A sealed amount of $SnBr_2$ (mg/ml) | A sealed amount of $SrI_2$ (mg/ml) | General color rendering index Ra | Special color rendering index for red color $R_9$ | Color temp. (° K) |
|---|---|---|---|---|---|
| 21 | 4.0 | 0.01 | 94 to 92 | 74 to 70 | 6300 to 5900 |
| 22 | 1.2 | 0.0013 | 95 to 92 | 74 to 71 | 6500 to 6000 |
| 23 | 0.3 | 0.1 | 97 to 92 | 84 to 75 | 6000 to 5600 |
| 24 | 1.0 | 0.9 | 98 to 92 | 86 to 81 | 5200 to 4800 |
| 25 | 0.02 | 0.6 | 84 to 77 | 66 to 59 | 9000 to 8400 |
| 26 | 0.02 | 0.03 | 81 to 76 | 55 to 27 | 11000 to 8800 |

Figure 7:
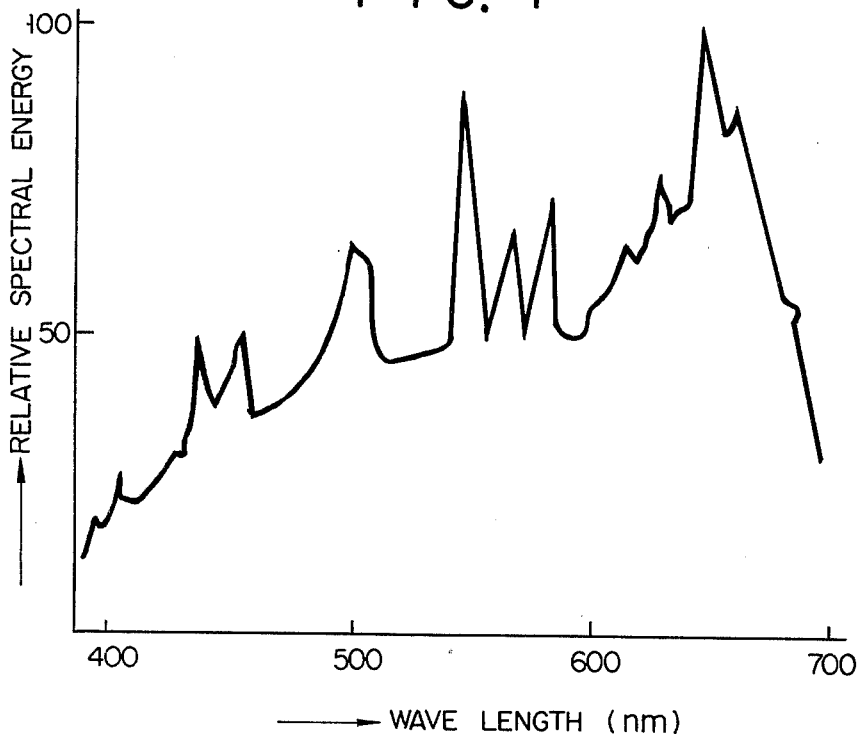

A wavelength-relative spectral energy ratio characteristic curve for the sample 23 is shown in FIG. 7.

When 0.1 to 5.0 mg/ml of tin bromide and 0.01 to 2.0 mg/ml of strontium iodide were sealed, a high color rendering property was observed.

EXAMPLE 13

Discharge lamps the same type as in Example 1 were prepared by sealing 20 torrs of argon gas (inerg gas), 2 to 2.5 mg/ml of mercury, a varying amount of $SnBr_2$ and a varying amount of $SrCl_2$. The following are the result of experiments when the discharge lamps were operated at an input power of 400W.

Table 7

| Sample No. | A sealed amount of $SnBr_2$ (mg/ml) | A sealed amount of $SrCl_2$ (mg/ml) | General color rendering index Ra | Special color rendering index for red color $R_9$ | Color temp. (° K) |
|---|---|---|---|---|---|
| 27 | 4.0 | 0.01 | 94 to 90 | 77 to 74 | 6300 to 5900 |
| 28 | 1.2 | 0.001 | 94 to 92 | 73 to 70 | 6300 to 6000 |
| 29 | 0.64 | 0.31 | 87 to 83 | 89 to 86 | 5600 to 5200 |
| 30 | 1.0 | 1.6 | 85 to 67 | 71 to 64 | 5100 to 4600 |
| 31 | 0.02 | 0.53 | 80 to 74 | 67 to 51 | 10800 to 8200 |

When 0.1 to 5.0 mg/ml of tin bromide and 0.1 to 2.0 mg/ml of strontium chloride were sealed, a high color rendering property was obtained.

EXAMPLE 14

Discharge lamps the same type as in Example 1 were prepared by sealing 20 torrs of argon gas (inert gas), 2 to 2.5 mg/ml of mercury, a varying amount of $SnI_2$ and a varying amount of $SrBr_2$ into a luminous sealed tube having a spacing between main electrodes of 40 mm and an inner volume of 13 ml. Test was conducted at an input power of 400W, the results of which are shown in Table 8.

Table 8

| Sample No. | A sealed amount of $SnI_2$ (mg/ml) | A sealed amount of $SrBr_2$ (mg/ml) | General color rendering index Ra | Special Color rendering index for red color $R_9$ | Color temp. (° K) |
|---|---|---|---|---|---|
| 32 | 4.0 | 0.01 | 94 to 90 | 78 to 76 | 4200 to 3700 |
| 33 | 1.2 | 0.0013 | 94 to 91 | 76 to 72 | 4200 to 3600 |
| 34 | 0.54 | 0.42 | 96 to 94 | 84 to 80 | 4300 to 3800 |
| 35 | 1.0 | 1.7 | 91 to 86 | 81 to 74 | 5500 to 4900 |
| 36 | 0.02 | 0.53 | 84 to 77 | 80 to 76 | 6600 to 5900 |

Figure 8:
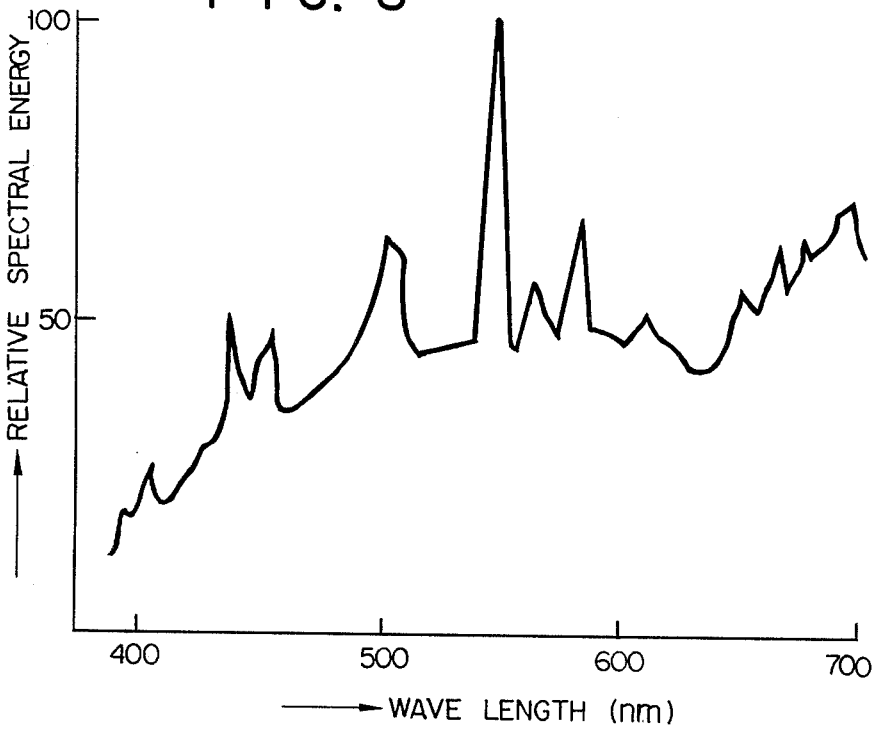

A wavelength-relative spectral energy ratio characteristic curve for the sample 35 is shown in FIG. 8.

When 0.1 to 3.0 mg/ml of tin iodide and 0.01 to 3.0 mg/ml of strontium bromide were sealed, a high color rendering property was observed.

EXAMPLE 15

Discharge lamps the same type as in Example 1 were prepared by inserting a varying amount of $SnBr_2$ as tin halide and a varying amount of $SrBr_2$ as strontium halide. When 1.1 to 5.0 mg/ml of $SnBr_2$ and 0.01 to 2.0 mg/ml of $SrBr_2$ were sealed, a high color rendering property was obtained.

EXAMPLE 16

Discharge lamps the same type as in Example 1 were prepared by sealing $SnI_2$ as tin halide and $SrCl_2$ as strontium halide. When 0.1 to 3.0 mg/ml of $SnI_2$ and 0.3 to 1.0 mg/ml of $SrCl_2$ were sealed, a high color rendering property was observed.

EXAMPLE 17

Discharge lamps the same type as in Example 1 were prepared by sealing $SnCl_2$ as tin halide and $SrI_2$ as strontium halide. When 0.1 to 3.0 mg/ml of $SnCl_2$ and 0.1 to 2.0 mg/ml of $SrI_2$ were sealed, a high color rendering property was revealed.

EXAMPLE 18

Discharge lamps the same type as in Example 1 were prepared by sealing $SnCl_2$ as tin halide and $SrBr_2$ as strontium halide. When 0.1 to 3.0 mg/ml of $SnCl_2$ and 0.01 to 2.0 mg.ml of $SrBr_2$ were sealed, a high color rendering property was observed.

EXAMPLE 19

Discharge lamps the same type as in Example 1 were prepared by sealing $SnCl_2$ as tin halide and $SrCl_2$ as strontium halide. When 0.1 to 3.0 mg/ml of $SnCl_2$ and 0.1 to 1.0 mg/ml of $SrCl_2$ were sealed, a high color rendering property was obtained.

When the halides are composed of tin halide (exlusive of tin fluoride) and strontium halide (exclusive of strontium fluoride) as in the case of Examples 12 to 19, a high color rendering property was obtained by sealing 0.1 to 5.0 mg of tin halide and 0.01 to 3.0 mg of strontium halide per ml of the inner volume of a luminous tube.

EXAMPLE 20

Discharge lamps the same type as in Example 1 were prepared by sealing into a luminous sealed tube having a spacing between main electrodes of 50 mm and inner volume of 17 ml, 20 torrs of argon gas (inert gas), 2 to 2.5 mg/ml of mercury, a varying amount of $SnBr_2$ as tin halide, a varying amount of $SrI_2$ as strontium halide and a varying amount of $CaBr_2$as calcium halide. The discharge lamps were tested at an input power of 400W.

As a result, a high color rendering property was found to be obtained by sealing 0.1 to 5.0 mg/ml of tin bromide, a 0.01 to 2.0 mg/ml of strontium iodide and 0.01 to 2.0 mg/ml of calcium bromide. The results of experiments were shown in Table 9.

Table 9

| Sample No. | A sealed amount of $SnBr_2$ (mg/ml) | A sealed amount of $SrI_2$ (mg/ml) | A sealed amount of $CaBr_2$ (mg/ml) | General color rendering index Ra | Special color rendering index for red color $R_9$ | Color temperature (° K) |
|---|---|---|---|---|---|---|
| 37 | 4.0 | 0.01 | 0.014 | 96 to 92 | 84 to 80 | 6200 to 5800 |
| 38 | 1.03 | 0.002 | 0.001 | 94 to 90 | 78 to 74 | 5800 to 5500 |
| 39 | 0.7 | 0.12 | 0.16 | 99 to 96 | 99 to 96 | 5000 to 4400 |
| 40 | 1.02 | 1.21 | 0.62 | 98 to 96 | 98 to 93 | 4700 to 4100 |
| 41 | 0.06 | 0.31 | 0.29 | 87 to 83 | 78 to 68 | 8800 to 7800 |

EXAMPLE 21

Discharge lamps the same type as in FIG. 1 were prepared by sealing 20 torrs of argon gas (inert gas), 2 to 2.5 mg/ml of mercury, a varying amount of $SnBr_2$ as tin halide, a varying amount of $SrCl_2$ as strontium halide and a varying amount of $CaI_2$ as calcium halide into a luminous sealed tube having a spacing between main electrodes of 50 mm and an inner volume of 17ml. A high rendering property was found to be obtained by sealing 0.1 to 5.0 mg/ml of tin bromide, a 0.01 to 2.0 mg/ml of strontium chloride and 0.01 to 2.0 mg/ml of calcium iodide. The following are the results of experiments when an input power was 400W.

Table 10

| Sample No. | A sealed amount of $SnBr_2$ (mg/ml) | A sealed amount of $SrCl_2$ (mg/ml) | A sealed amount of $CaI_2$ (mg/ml) | General color rendering index Ra | Special color rendering index for red color $R_9$ | Color temperature (° K) |
|---|---|---|---|---|---|---|
| 42 | 4.0 | 0.01 | 0.014 | 94 to 91 | 78 to 74 | 6200 to 5800 |
| 43 | 1.03 | 0.003 | 0.001 | 94 to 90 | 76 to 70 | 6300 to 5700 |
| 44 | 0.73 | 0.10 | 0.18 | 98 to 94 | 83 to 77 | 5800 to 5200 |
| 45 | 1.0 | 0.92 | 0.6 | 98 to 95 | 94 to 90 | 5400 to 4800 |
| 46 | 0.04 | 0.33 | 0.28 | 78 to 72 | 69 to 53 | 12000 to 8800 |

EXAMPLE 22

When 0.1 to 3.0 mg/ml of at least one kind selected from the group consisting of tin iodide and tin chloride as tin halide, 0.01 to 3.0 mg/ml of strontium bromide as strontium halide and 0.01 to 3.0 mg/ml of calcium bromide as calcium halide were sealed into a luminous sealed tube the same type as in Example 1, a high rendering property was obtained. In this case, the tube wall temperature can be more easily raised than when no calcium bromide is sealed.

EXAMPLE 23

When 0.1 to 3.0 mg/ml of tin chloride as tin halide, 0.01 to 2.0 mg/ml of strontium chloride as strontium halide, and 0.01 to 3.0 mg/ml of at least one kind selected from the group consisting of calcium bromide and calcium iodide as calcium halide were sealed into a luminous sealed tube the same type as in Example 1, a high color rendering property was obtained. In this case, the tube wall temperature can be more easily raised than when no calcium halide was sealed.

Where halides were comprised of tin halide (exclusive of tin fluoride), calcium halide (exclusive of calcium fluoride) and strontium halide (exclusive of strontium fluroide), a high color rendering property was found to be obtained when 0.1 to 5.0 mg of said tin halide, 0.01 to 3.0 mg of said calcium halide and 0.01 to 3.0 mg of said strontium halide, respectively per ml of an inner volume of a luminous sealed tube, were sealed into the luminous sealed tube.

In each of the above-mentioned Examples, a lesser amount of tin halide resulted in no sufficient light emission. Generally, an effect on the light emission by mercury appeared intensely, showing a tendency for the color temperature to be raised. Since the general color rendering index Ra or the special color rendering index for red color $R_9$ becomes a low value, it is necessary that a sufficient amount of tin halide be sealed.

Since in general strontium halide (exclusive of iodine) is low in vapor pressure than calcium halide, if calcium halide is sealed together with tin halide and strontium halide into the luminous sealed tube as in Examples 20 to 23, it is possible to increase a vapor pressure within the luminous sealed tube. In consequence, if this is compared with the case where no calcium halide is sealed, the tube wall temperature can be sufficiently raised, even when use is made of a luminous sealed tube having a greater inner volume and a greater spacing between the electrodes.

A molecular light emission of strontium halide such as $SrI_2$, $SrBr_2$, $SrCl_2$ is distributed over a wide range close to 600 nm, though its center wavelength is distributed in a range close to 650 nm. The red component is not inferior to that as obtained from calcium halide, such as $CaBr_2$, the luminescence center wavelength of which is located near to 630 nm. The discharge lamp of this invention has an efficiency of 60 to 65 lm/W and involves no cloudiness of the luminous sealed tube and it also involves a lesser degree of reaction with a tungsten electrode. As a result, it is possible to obtain a stable discharge lamp having a lengthy service life.

It is to be noted that halides can be sealed, in the form of $SnSrBr_4$ etc., into the luminous sealed tube.

In Examples 12 to 23, even when two kinds of halogens (for example, bromine and iodine) are sealed or the other halogens are added in a certain amount, no greater influence is exerted over the characteristic. According to this invention, therefore, no specific explanation is not be made of Examples in which two or three kinds of halogens are used.

What we claim is:

1. A metal halide lamp including a luminous sealed tube containing a pair of discharge electrodes and having an ionizable inert gas, mercury and halides sealed therein, said halides comprising at least one kind selected from the group consisting of tin chloride, tin bromide and tin iodide, and at least one kind selected from the group consisting of calcium chloride, calcium bromide, calcium iodide, strontium chloride, strontium bromide, and strontium iodide.

2. A metal halide lamp according to claim 1, in which said halides comprise at least one kind of tin halide selected from the group consisting of tin chloride, tin bromide and tin iodide and at least one kind of calcium halide selected from the group consisting of calcium chloride, calcium bromide and calcium iodide, and an amount of said tin halide is 0.1 to 5.0 mg per ml of an inner volume of said tube and an amount of said calcium halide is 0.005 to 3.0 mg per ml of the inner volume of said tube.

3. A metal halide lamp according to claim 1, in which said halides comprises at least one kind of tin halide selected from the group consisting of tin chloride, tin bromide and tin iodide and at least one kind of strontium halide selected from the group consisting of strontium chloride, strontium bromide and strontium iodide, and an amount of said tin halide is 0.1 to 5.0 mg per ml of the inner volume of said tube and an amount of said strontium halide is 0.01 to 3.0 mg per ml of the inner volume of the tube.

4. A metal halide lamp according to claim 1, in which said halides comprise at least one kind of tin halide selected from the group consisting of tin chloride, tin bromide and tin iodide, at least one kind of calcium halide selected from the group consisting of calcium chloride, calcium bromide and calcium iodide, and at least one kind of strontium halide selected from the group consisting of strontium chloride, strontium bromide and strontium iodide, and an amount of said tin halide is 0.1 to 5.0 mg per ml of the inner volume of said tube, an amount of said calcium halide is 0.01 to 3.0 mg per ml of the inner volume of said tube and an amount of said strontium halide is 0.01 to 3.0 mg per ml of the inner volume of said tube.

* * * * *